US007295886B2

(12) United States Patent
Shibata

(10) Patent No.: US 7,295,886 B2
(45) Date of Patent: Nov. 13, 2007

(54) TARGET LENS SHAPE MEASURING APPARATUS, EYEGLASS LENS PROCESSING SYSTEM HAVING THE SAME, AND EYEGLASS LENS PROCESSING METHOD

(75) Inventor: Ryoji Shibata, Toyokawa (JP)

(73) Assignee: Nidek Co., Ltd., Aichi (JP)

( * ) Notice: Subject to any disclaimer, the term of this patent is extended or adjusted under 35 U.S.C. 154(b) by 160 days.

(21) Appl. No.: 11/119,393

(22) Filed: May 2, 2005

(65) Prior Publication Data

US 2005/0251280 A1 Nov. 10, 2005

(30) Foreign Application Priority Data

Apr. 30, 2004 (JP) ..... P2004-136387

(51) Int. Cl.
*G06F 19/00* (2006.01)

(52) U.S. Cl. ..... 700/157; 451/5

(58) Field of Classification Search ..... 700/117, 700/157; 451/5, 43, 44; 331/28, 200; 702/155
See application file for complete search history.

(56) References Cited

U.S. PATENT DOCUMENTS 5,347,762 A * 9/1994 Shibata et al. ..... 451/5
RE35,898 E 9/1998 Shibata et al.
6,250,989 B1 * 6/2001 Mizuno ..... 451/5
6,263,583 B1 7/2001 Mizuno
6,325,700 B1 12/2001 Mizuno et al.
6,702,653 B2 * 3/2004 Shibata ..... 451/42

FOREIGN PATENT DOCUMENTS

JP 6-74750 A 3/1994

* cited by examiner

*Primary Examiner*—Kidest Bahta
(74) *Attorney, Agent, or Firm*—Sughrue Mion Pllc.

(57) ABSTRACT

A method of processing an eyeglass lens includes: a first step of obtaining an actual three-dimensional target lens shape from a rim of an eyeglass frame; a second step of obtaining a circumferential length of the actual three-dimensional target lens shape and a two-dimensional target lens shape based on the actual three-dimensional target lens shape; a third step of transmitting at least the two-dimensional target lens shape without transmitting the circumferential length of the actual three-dimensional target lens shape; a fourth step of obtaining a circumferential length of a three-dimensional target lens shape restored based on the transmitted two-dimensional target lens shape; a fifth step of obtaining a bevel path having a circumferential length that substantially accords with the circumferential length of the restored three-dimensional target lens shape; and a sixth step of forming a bevel on a peripheral edge surface of the lens based on the obtained bevel path.

14 Claims, 5 Drawing Sheets

TARGET LENS SHAPE MEASURING APPARATUS, EYEGLASS LENS PROCESSING SYSTEM HAVING THE SAME, AND EYEGLASS LENS PROCESSING METHOD

BACKGROUND OF THE INVENTION

The present invention is related to a target lens shape measuring apparatus, an eyeglass lens processing system having the same and an eyeglass lens processing method.

U.S. Pat. No. Re.35,898 (Japanese Unexamined Patent Publication: H05-212661), for example, owned by the assignee of the present application discloses a method of processing an eyeglass lens as follows. That is, firstly, a three-dimensional target lens (shape) of a rim (lens frame) of an eyeglass frame is measured and a circumferential length thereof (hereinafter referred to as "three-dimensional target lens circumferential length) is obtained. Secondly, a bevel path having a circumferential length substantially identical to the obtained three-dimensional target lens circumferential length is obtained. Then, a bevel is formed on a peripheral (circumferential) edge surface of the lens based on the obtained bevel path. By obtaining the bevel path so as to be substantially identical to the three-dimensional target lens circumferential length with the above-described manner, the lens formed with the bevel can be fitly fitted to the rim.

Recently, the lenses are processed concentrically at a lens processing center, and data for processing is transmitted from an eyeglass shop to the lens processing center through-a communication line.

In such as a case, if the data on the three-dimensional target lens circumferential length is transmitted as the data for processing, there is no problem. However, if the data on the three-dimensional target lens circumferential length is not transmitted, the lens may not be able to be processed so as to be fitly fitted to the rim.

SUMMARY OF THE INVENTION

In view of the foregoing problem, the present invention has been conceived with an object to provide a target lens shape measuring apparatus, an eyeglass lens processing system having the same and an eyeglass lens processing method, that allows performing high precision lens processing even when the data on the three-dimensional target lens circumferential length cannot be transmitted to the processing side.

In order to achieve the foregoing object, the present invention provides the following.

(1) A method of processing an eyeglass lens comprising:

a first step of obtaining an actual three-dimensional target lens shape from a rim of an eyeglass frame;

a second step of obtaining a circumferential length of the actual three-dimensional target lens shape and a two-dimensional target lens shape based on the actual three-dimensional target lens shape;

a third step of transmitting at least the two-dimensional target lens shape without transmitting the circumferential length of the actual three-dimensional target lens shape;

a fourth step of obtaining a circumferential length of a three-dimensional target lens shape restored based on the transmitted two-dimensional target lens shape;

a fifth step of obtaining a bevel path having a circumferential length that substantially accords with the circumferential length of the restored three-dimensional target lens shape; and a sixth step of forming a bevel on a peripheral edge surface of the lens based on the obtained bevel path.

(2) The method according to (1) further comprising a step of obtaining a radius of a sphere in which a circumferential length of an imaginary three-dimensional target lens shape obtained by projecting the two-dimensional target lens shape onto the sphere substantially accords with the circumferential length of the actual three-dimensional target lens shape, wherein in the third step, the two-dimensional target lens shape and the sphere radius are transmitted, and wherein in the fourth step, the circumferential length of the restored three-dimensional target lens shape is obtained based on the transmitted two-dimensional target lens shape and the transmitted sphere radius.

(3) The method according to (1) further comprising:

a step of obtaining a radius of a sphere on which the actual three-dimensional target lens shape is; and a step of obtaining a corrected two-dimensional target lens shape in which a circumferential length of an imaginary three-dimensional target lens shape obtained by projecting the corrected two-dimensional target lens shape onto the sphere substantially accords with the circumferential length of the actual three-dimensional target lens shape, wherein in the third step, the corrected two-dimensional target lens shape and the sphere radius are transmitted, and wherein in the fourth step, the circumferential length of the restored two-dimensional target lens shape is obtained based on the transmitted corrected two-dimensional target lens shape and the transmitted sphere radius.

(4) The method according to (1) further comprising a step of obtaining a corrected two-dimensional target lens shape in which a circumferential length of the corrected two-dimensional target lens shape substantially accords with the circumferential length of the actual three-dimensional target lens shape, wherein in the third step, the corrected two-dimensional target lens shape is transmitted, and wherein in the fourth step, the circumferential length of the restored three-dimensional target lens shape is obtained the circumferential length of the transmitted corrected two-dimensional target lens shape.

(5) The method according to (1) further comprising a step of obtaining a correction coefficient for correcting the two-dimensional target lens shape so that the circumferential length of the corrected two-dimensional target lens shape substantially accords with the circumferential length of the actual three-dimensional target lens shape, wherein in the third step, the two-dimensional target lens shape and the correction coefficient are transmitted, and wherein in the fourth step, the circumferential length of the restored three-dimensional target lens shape is obtained based on the circumferential length of the transmitted two-dimensional target lens shape and the transmitted correction coefficient.

(6) An eyeglass lens processing system comprising:

a target lens shape measuring apparatus that obtains an actual three-dimensional target lens shape from a rim of an eyeglass frame;

an eyeglass lens processing apparatus that forms a bevel on a peripheral edge surface of an eyeglass lens; and a transmitting portion that connects the measuring apparatus to the processing apparatus, wherein the measuring apparatus includes a first arithmetic portion for obtaining a circumferential length of the actual three-dimensional target lens shape and a two-dimensional target lens shape based on the actual three-dimensional target lens shape, wherein the transmitting portion transmits at least the two-dimensional target lens shape without transmitting the circumferential length of the actual three-dimensional target lens shape, wherein the processing apparatus includes a second arithmetic portion for obtaining a circumferential length of a three-dimensional target lens shape restored based on the transmitted two-dimensional target lens shape, and obtaining-a bevel path having a circumferential length that substantially accords with the circumferential length of the restored three-dimensional target lens shape.

(7) The eyeglass lens processing system according to (6), wherein the first arithmetic portion obtains a radius of a sphere in which a circumferential length of an imaginary three-dimensional target lens shape obtained by projecting the two-dimensional target lens shape onto the sphere substantially accords with the circumferential length of the actual three-dimensional target lens shape, wherein the transmitting portion transmits the two-dimensional target lens shape and the sphere radius, and wherein the second arithmetic portion obtains the circumferential length of the restored three-dimensional target lens shape based on the transmitted two-dimensional target lens shape and the transmitted sphere radius.

(8) The eyeglass lens processing system according to (6), wherein the first arithmetic portion obtains a radius of a sphere on which the actual three-dimensional target lens shape is, and obtains a corrected two-dimensional target lens shape in which a circumferential length of an imaginary three-dimensional target lens shape obtained by projecting the corrected two-dimensional target lens shape onto the sphere substantially accords with the circumferential length of the actual three-dimensional target lens shape, wherein the transmitting portion transmits the corrected two-dimensional target lens shape and the sphere radius, and wherein the second arithmetic portion obtains the circumferential length of the restored two-dimensional target lens shape based on the transmitted corrected two-dimensional target lens shape and the transmitted sphere radius.

(9) The eyeglass lens processing system according to (6), wherein the first arithmetic portion obtains a corrected two-dimensional target lens shape in which a circumferential length of the corrected two-dimensional target lens shape substantially accords with the circumferential length of the actual three-dimensional target lens shape, wherein the transmitting portion transmits the corrected two-dimensional target lens shape, and wherein in the fourth step, the circumferential length of the restored three-dimensional target lens shape is obtained based on the circumferential length of the transmitted corrected two-dimensional target lens shape.

(10) The eyeglass lens processing system according to (1), wherein the first arithmetic portion obtains a correction coefficient for correcting the two-dimensional target lens shape so that the circumferential length of the corrected two-dimensional target lens shape substantially accords with the circumferential length of the actual three-dimensional target lens shape, wherein the transmitting portion transmits the two-dimensional target lens shape and the correction coefficient, and wherein the second arithmetic portion obtains the circumferential length of the restored three-dimensional target lens shape based on the circumferential length of the transmitted two-dimensional target lens shape and the transmitted correction coefficient.

(11) A target lens shape measuring apparatus comprising:

a measuring portion that obtains an actual three-dimensional target lens shape from a rim of an eyeglass frame;

an arithmetic portion that obtains a circumferential length of the actual three-dimensional target lens shape and a two-dimensional target lens shape based on the actual three-dimensional target lens shape; and an outputting portion that outputs at least the two-dimensional target lens shape without outputting the circumferential length of the actual three-dimensional target lens shape.

(12) The target lens shape measuring apparatus according to (11), wherein the arithmetic portion obtains a radius of a sphere in which a circumferential length of an imaginary three-dimensional target lens shape obtained by projecting the two-dimensional target lens shape onto the sphere substantially accords with the circumferential length of the actual three-dimensional target lens shape, and the outputting portion transmits the two-dimensional target lens shape and the sphere radius.

(13) The target lens shape measuring apparatus according to (11), wherein the arithmetic portion obtains a radius of a sphere on which the actual three-dimensional target lens shape is, and obtains a corrected two-dimensional target lens shape in which a circumferential length of an imaginary three-dimensional target lens shape obtained by projecting the corrected two-dimensional target lens shape onto the sphere substantially accords with the circumferential length of the actual three-dimensional target lens shape, and wherein the transmitting portion transmits the corrected two-dimensional target lens shape and the sphere radius.

(14) The target lens shape measuring apparatus according to (11), wherein the arithmetic portion obtains a corrected two-dimensional target lens shape in which a circumferential length of the corrected two-dimensional target lens shape substantially accords with the circumferential length of the actual three-dimensional target lens shape, and wherein the outputting portion transmits the corrected two-dimensional target lens shape.

(15) The target lens shape measuring apparatus according to (11), wherein the arithmetic portion obtains a correction coefficient for correcting the two-dimensional target lens shape so that the circumferential length of the corrected two-dimensional target lens shape substantially accords with the circumferential length of the actual three-dimensional target lens shape, and wherein the outputting portion transmits the two-dimensional target lens shape and the correction coefficient.

DETAILED DESCRIPTION OF PREFERRED EMBODIMENTS

Figure 1:
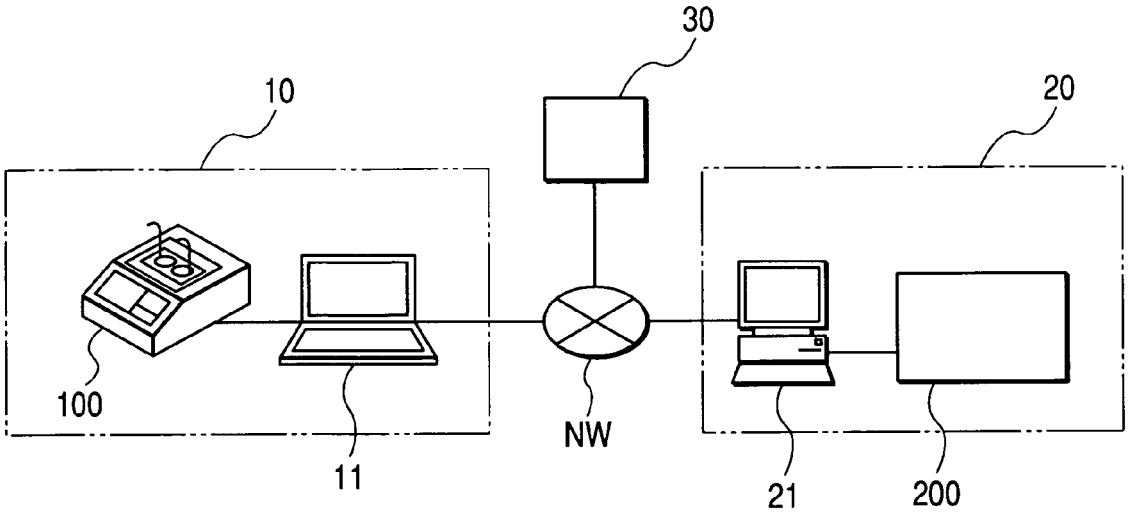
FIG. 1 is a schematic block diagram of an eyeglass lens processing system.

Embodiments according to the present invention will be described hereunder with reference the accompanying drawings. FIG. 1 is a schematic block diagram of an eyeglass lens processing system.

In an eyeglass shop 10, an order-issuing terminal 11 and a target lens shape measuring apparatus 100 are installed. In a lens processing workshop 20 an order-receiving terminal 21 and an eyeglass lens processing apparatus 200 are installed. The lens processing workshop 20 includes a lens manufacturer, a lens processing center and the like. The order-issuing terminal PC 11 and the order-receiving terminal 21 are communicably connected to a server 30 of a communications network NW. Ordering data including information on a target lens shape is transmitted from the order-issuing terminal 11, and is received by the order-receiving terminal 21 via the server 30. Each of the order-issuing terminal 11 and the order-receiving terminal 21 are a computer provided with a display monitor and an inputting device such as a keyboard and a mouse. The order-receiving terminal 21 of the lens processing workshop 20 is connected to the order-issuing terminals 11 of a plurality of eyeglass shops 10. Although FIG. 1 only shows one each of the eyeglass shop 10 and the lens processing workshop 20, actually a plurality of these are connected to one another via the communications network NW.

Figure 2:
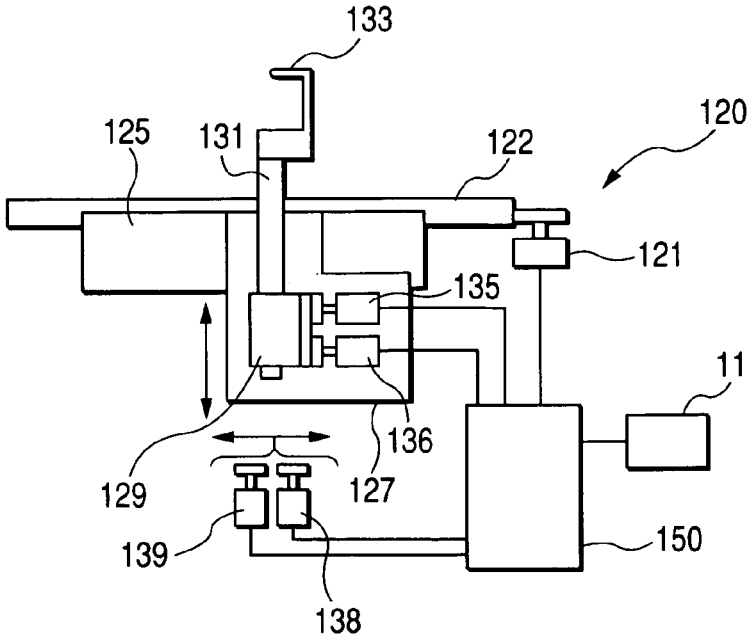
FIG. 2 is a schematic block diagram of a measuring mechanism incorporated in a target lens shape measuring apparatus.

FIG. 2 is a schematic block diagram of a measuring mechanism 120 incorporated in the target lens shape measuring apparatus 100. The measuring mechanism 120 includes a rotating base 122 driven by a pulse motor 121, a fixed block 125 fixed to the rotating base 122, a horizontally-moving carriage 127 movably supported by the fixed block 125 in a left and right direction in FIG. 2, a vertically-moving carriage 129 movably supported by the horizontally-moving carriage 127 in an upward and downward direction in FIG. 2, a gauge head shaft 131 rotatably attached to the vertically-moving carriage 129, a gauge head 133 attached at the upper end of the gauge head shaft 131, with the tip thereof aligned with the central axis of the gauge head shaft 131, a motor 135 for vertically driving the vertically-moving carriage 129, an encoder 136 that detects a travel of the vertically-moving carriage 129, a motor 138 for horizontally driving the horizontally-moving carriage 127, and an encoder 139 that detects a travel of the horizontally-moving carriage 127. The motors and the encoders are connected to an arithmetic control unit 150.

When measuring a target lens shape, the eyeglass frame is fixed to a frame holder (for example, according to Japanese Unexamined Patent Publication No.2000-314617 (U.S. Pat. No. 6,325,700)) which is not shown in FIG. 2, before starting the measurement. The arithmetic control unit 150 drives the motors 135 and 138 such that the tip of the gauge head 133 contacts an inner groove of the rim of the eyeglass frame. Then, the pulse motor 121 is rotated at predetermined pulses per rotation. This rotation causes the gauge head 133 and the horizontally-moving carriage 127 to horizontally move along a radius vector of the rim, and the encoder 139 detects the movement. Also this rotation causes the gauge head 133 and the vertically-moving carriage 129 to vertically move along a curve (warp) of the rim, and the encoder 136 detects the movement. The three-dimensional shape (three-dimensional target lens shape) of the inner groove of the rim is measured as (rn, θn, zn) (n=1, 2, . . . , N) based on a rotational angle (radius vector angle) θ of the rotating base 122 driven by the pulse motor 121, a horizontal travel(radius vector length) r detected by the encoder 139 and a vertical travel z detected by the encoder 136. It is to be noted that the details of this measuring mechanism are basically similar to those described in Japanese Unexamined Patent Publication No. 2000-314617 (U.S. Pat. No. 6,325,700). The arithmetic control unit 150 obtains a frame PD (separation between geometrical centers of the left and right rims), through the measurement of the left and right rims. With respect to the three-dimensional target lens shape, the shape data of a rim may be symmetrically inverted, to be employed as the shape data of the other rim.

Figure 3:
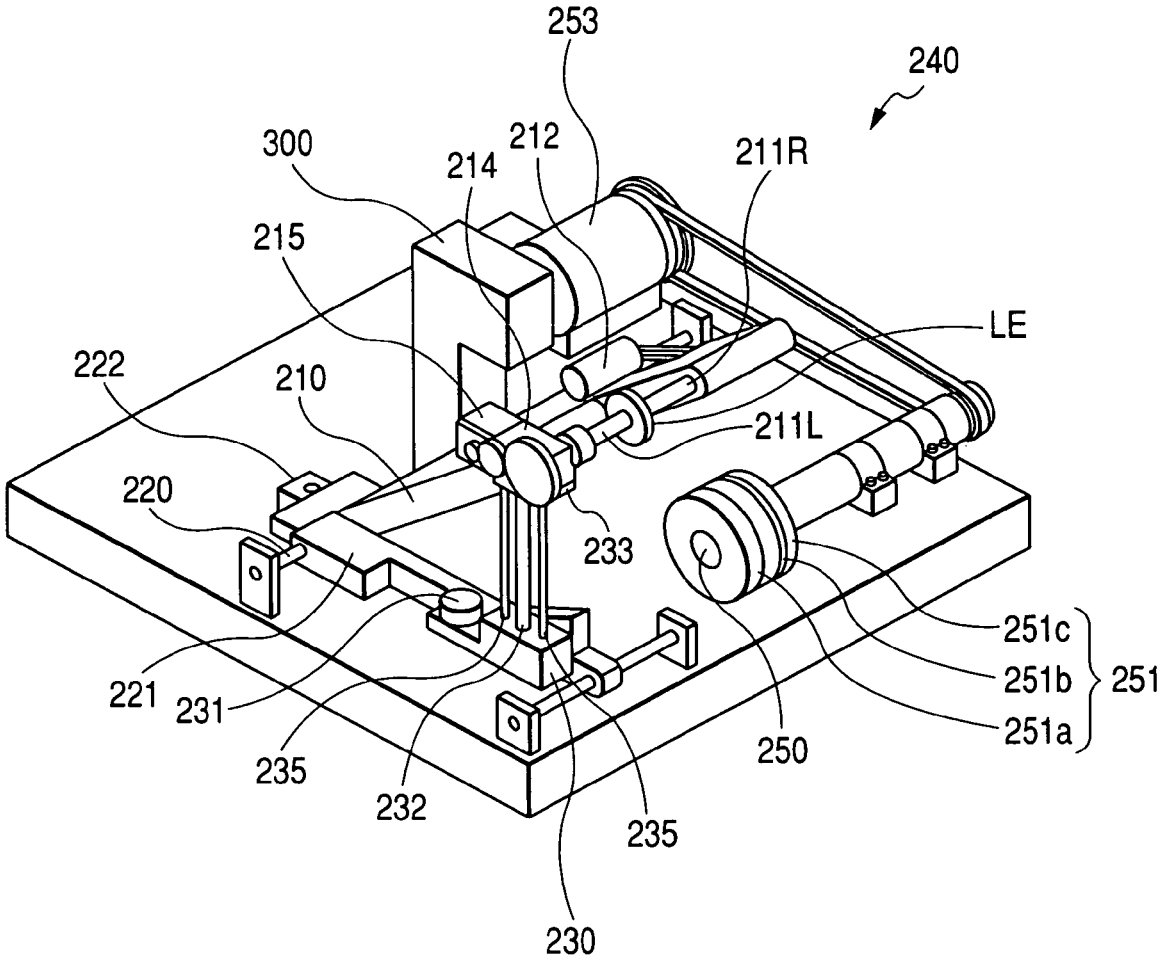
FIG. 3 is a schematic block diagram of a processing mechanism incorporated in an eyeglass lens processing apparatus.

FIG. 3 is a schematic block diagram of a processing mechanism 240 incorporated in the eyeglass lens processing apparatus 200. A lens to be processed LE is held by two lens rotating shafts 211R and 211L attached to a carriage 210, to be ground by a grindstone 251 attached to a grindstone rotating shaft 250. The grindstone 251 includes three grindstones, namely a roughing grindstone 251*a* for plastics, a roughing grindstone 251*b* for glasses and a finishing grindstone 251*c* provided with a beveling groove and a flat processing surface. The grindstone rotating shaft 250 is rotated by a motor 253.

A motor mounting block 214 is attached on the left arm side of the carriage 210 and is rotatable about an axial line of the lens rotating shaft 211L. A lens rotating motor 215 is mounted on the block 214, so that the rotation of the motor 215 is transmitted to the lens rotating shaft 211L via a gear and so on. A chuck motor 212 is attached on the right arm side of the carriage 210 for moving the lens rotating shaft 211R in an axial direction.

The carriage 210 is rotatable and slidable with respect to a carriage shaft 220 disposed parallel to the lens rotating shafts 211R and 211L, so as to be driven by a motor 222 in a left and right direction together with a moving arm 221.

A swinging block 230 is attached to the moving arm 221 and is rotatable about an axial line that is aligned with the center of the grindstone rotating shaft 250. The swinging block 230 is provided with a carriage driving motor 231 and a feeding screw 232, and the rotation of the motor 231 is transmitted to the feeding screw 232 via a belt and so on. A guide block 233 is fixed to the upper end of the feeding screw 232 so as to be abutted to a lower end face of the motor mounting block 214, and the guide block 233 moves along two guide shafts 235 erected on the swinging block 230. Rotating the motor 231 causes the guide block 233 to move up and down, by which the carriage 210 can move up and down pivoting about the carriage shaft 220. Further, a spring (not shown) is provided between the carriage 210 and the moving arm 221, so as to constantly urge the carriage 210 downward, thus to press the lens LE against the grindstone 251.

Figure 4:
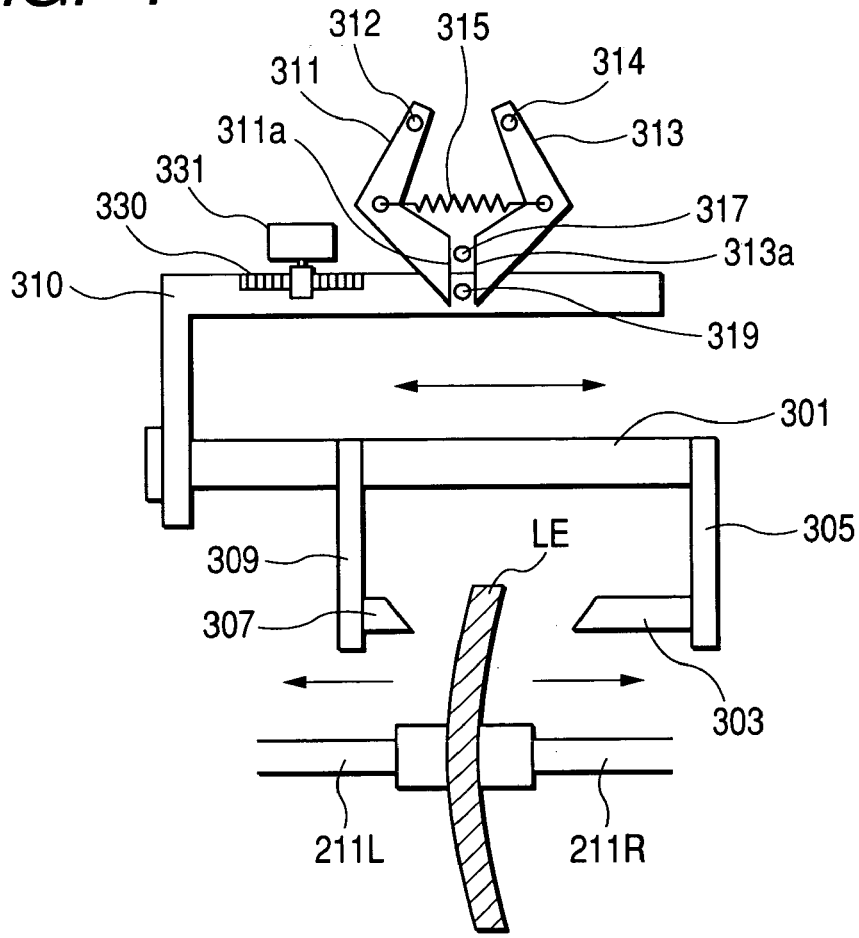
FIG. 4 is a schematic block diagram of a lens shape measuring unit.

A lens shape measuring unit 300 is placed behind the carriage 210. FIG. 4 is a schematic block diagram of the lens shape measuring unit 300 (detecting mechanism of a lens edge position). An arm 305 with a gauge head 303 for the rear face of the lens LE is attached to the right end of a shaft 301. An arm 309 with a gauge head 307 for the front face of the lens LE is attached to a central portion of the shaft 301. The tips of the gauge head 303 and the gauge head 307 are opposing each other. An axial line connecting the tip of the gauge head 303 and the tip of the gauge head 307 is parallel to axial lines of the lens rotating shafts 211L and 211R. The shaft 301 is movable along an axial direction of the lens rotating shafts 211L and 211R (axial direction of the shaft 301) together with a slide base 310.

The slide base 310 is provided with a rack 330 extending in a left and right direction, so that left and right movement of the slide base 310 is detected by an encoder 331 having a pinion being engaged with the rack 330. Behind the slide base 310, a driving plate 311 of a bent shape is pivotally attached around a shaft 312, and a driving plate 313 of an inverse bent shape is pivotally attached around a shaft 314. A spring 315 is provided between the driving plates 311 and 313 so as to urge the driving plates toward each other. A stopper pin 317 is provided between the end faces 311*a* and 313*a* of the driving plates 311 and 313. When an external force is not applied to the slide base 310, the end faces 311*a* and 313*a* of the driving plates 311 and 313 are both in contact with the stopper pin 317, and such a state constitutes the initial position of the left and right movement. A guide pin 319 is fixed to the slide base 310, so as to contact with the end faces 311*a* and 313*a* of the driving plates 311 and 313. When a force toward the right in FIG. 4 is applied to the slide base 310, the guide pin 319 pushes the end face 313*a* to the right, while the slide base 310 is urged by the spring 315 in a direction of the initial position. On the contrary, when a force toward the left in FIG. 4 is applied to the slide base 310, the guide pin 319 pushes the end face 311*a* to the left, while the slide base 310 is likewise urged by the spring 315 in a direction of the initial position. Based on such movement of the slide base 310, the encoder 331 detects a travel of the gauge head 303 contacting the rear face of the lens LE and a travel of the gauge head 307 contacting the front face of the lens LE. In addition, the shaft 301 is axially rotated by a motor (not shown), so as to move the gauge heads 303 and 307 from a non-operating position to a measuring position, which is the state shown in FIG. 4.

When measuring the lens shape, the lens LE is moved to the left in FIG. 4, so that the front face of the lens LE contacts the gauge head 307. The gauge head 307 is constantly urged toward the front face of the lens LE by the spring 315. Under such a state, the carriage 210 is moved up and down according to the radius vector information while the lens LE is being rotated, by which a position of an edge of the front face of the lens LE is detected by the encoder 331. In the same manner, bringing the gauge head 303 into contact with the rear face of the lens LE and moving the carriage 210 up and down according to the radius vector information while the lens LE is being rotated allows the encoder 331 to detect a position of an edge of the rear face of the lens LE.

Figure 5:
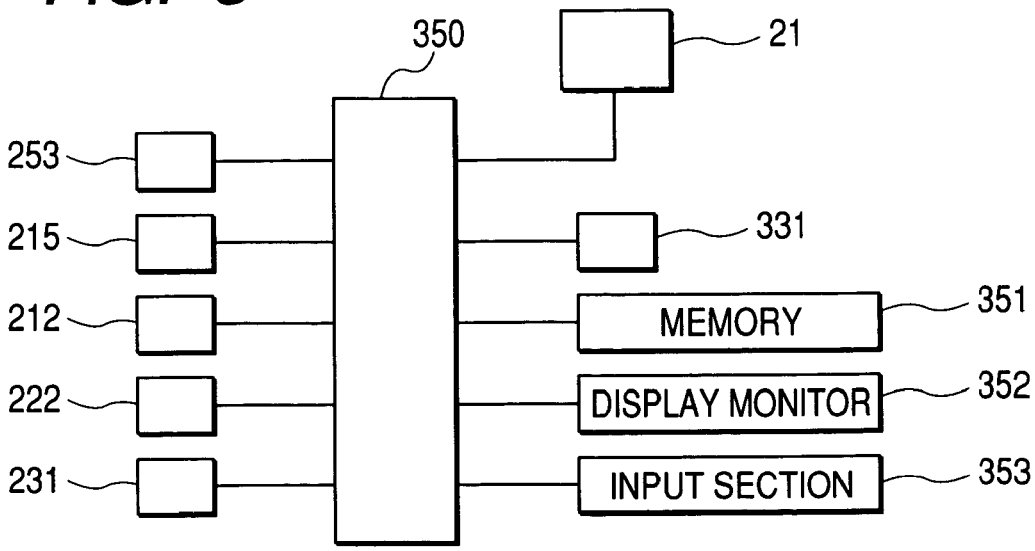
FIG. 5 is a schematic block diagram showing a control system of the processing apparatus.

FIG. 5 is a block diagram showing a control system of the processing apparatus 200. A memory 351, a display monitor 352, an input section 353 are connected to an arithmetic control unit 350 in addition to the motors 253, 215, 212, 222 and 231 and the encoder 331 of the lens shape measuring unit 300. The order-receiving terminal 21 is connected to the arithmetic control unit 350, so that the data transmitted from the order-issuing terminal 11 can be input thereto.

An operation of the foregoing processing system will be described. At the eyeglass shop 10, the target lens shape measuring apparatus 100 is employed to measure a target lens shape. Upon placing the eyeglass frame on the frame holder of the apparatus 100 and starting the measurement, the three-dimensional target lens shape is measured as (rn, θn, zn) (n=1, 2, . . . , N) as already stated. The arithmetic control unit 150 converts the three-dimensional target lens shape data (rn, θn, zn) into orthogonal coordinates data (xn, yn, zn).

The three-dimensional target lens shape data may remain in this format, however, it is preferable to correct the two-dimensional target lens shape data as follows.

Figure 6:
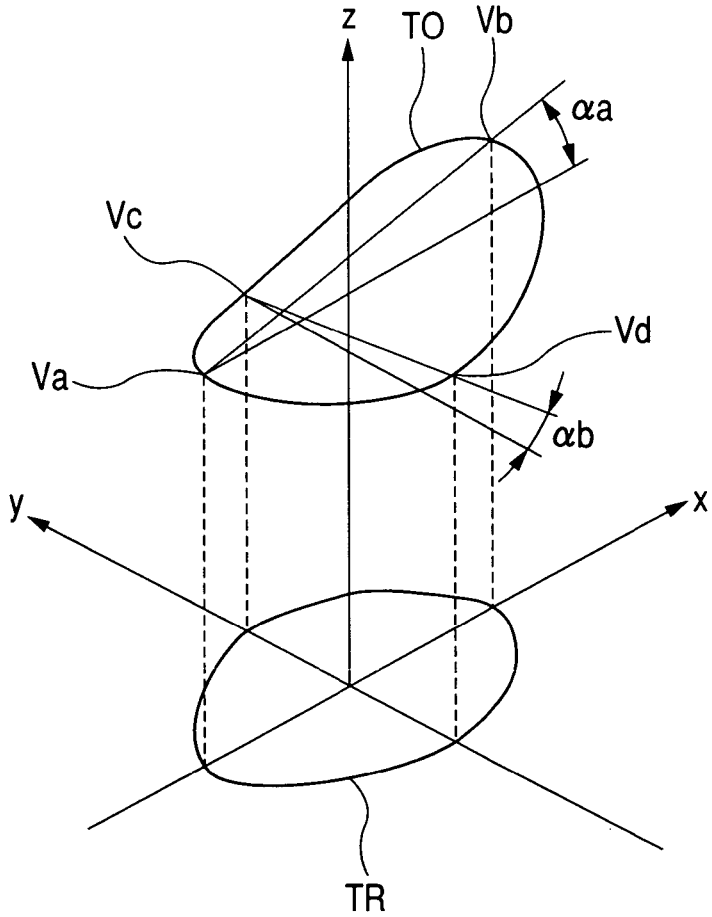
FIG. 6 is a graphic drawing for explaining a correction method of a two-dimensional target lens shape.
Figure 7A:
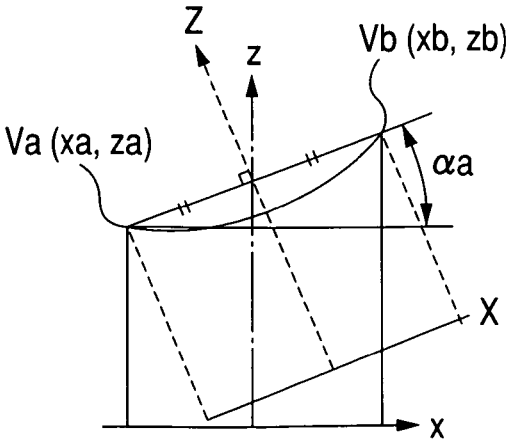
FIG. 7A and FIG. 7B are graphic drawings for explaining a correction method of a two-dimensional target lens shape.
Figure 7B:
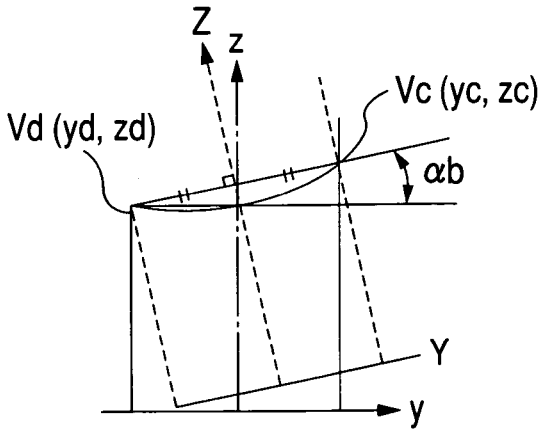

FIG. 6, FIG. 7A and FIG. 7B are drawings for explaining a correction method of the two-dimensional target lens shape data. Referring to FIG. 6, "TO" designates the three-dimensional target lens shape data (xn, yn, zn) on the orthogonal coordinates system xyz, and TR designates the two-dimensional target lens shape projected on the xy plane (xn, yn). An xz component (xa, za) of a point Va corresponding to a smallest value in the x-axis, and an xz component (xb, zb) of a point Vb corresponding to a greatest value in the x-axis are selected out of the x components of the three-dimensional target lens shape data (xn, yn, zn), and an angle of a line segment connecting the points Va and Vb with respect to the x-axis is defined as αa, as shown in FIG. 7. The direction inclined by the angle αa is regarded as a new X-axis. Likewise, a yz component (yc, zc) of a point Vc corresponding to a smallest value in the y-axis, and a yz component (yd, zd) of a point Vd corresponding to a greatest value in the y-axis are selected out of the y components of the three-dimensional target lens shape data (xn, yn, zn), and an angle of a line segment connecting the points Vc and Vd with respect to the y-axis is defined as αb, as shown in FIG. 7. Then, the direction inclined by the angle αb is regarded as a new Y-axis.

Further, a direction defined by a perpendicular bisector of the line segment connecting the points Va and Vb, and a perpendicular bisector of the line segment connecting the points Vc and Vd is regarded as a new Z-axis Then, the three-dimensional target lens shape data (xn, yn, zn) is converted into new three-dimensional target lens shape data (Xn, Yn, Zn) based on the new coordinate system XYZ, utilizing the angles αa and αb. Upon projecting the three-dimensional target lens shape data (Xn, Yn, Zn) onto the new XY plane, corrected two-dimensional target lens shape data (Xn, Yn) is obtained. The reference point of the XY coordinate system defined at this stage becomes the geometrical center of the two-dimensional target lens shape data (Xn, Yn) When processing the lens, the geometrical center of the target lens shape or the optical center of the lens LE is employed as the lens rotation axis. Therefore, utilizing the corrected two-dimensional target lens shape data allows minimizing a processing error that affects the warp of the rim.

Calculating distances between the respective data in the three-dimensional target lens shape data (Xn, Yn, Zn) (n=1, 2, . . . , N), and summing the distances gives a circumferential length FL of the actually measured three-dimensional target lens shape. Then, a radius of a sphere in which a circumferential length of an imaginary three-dimensional target lens shape obtained by projecting the two-dimensional target lens data (Xn, Yn) onto the sphere substantially accords with the circumferential length FL is calculated. Such calculation may be performed as follows.

Figure 8:
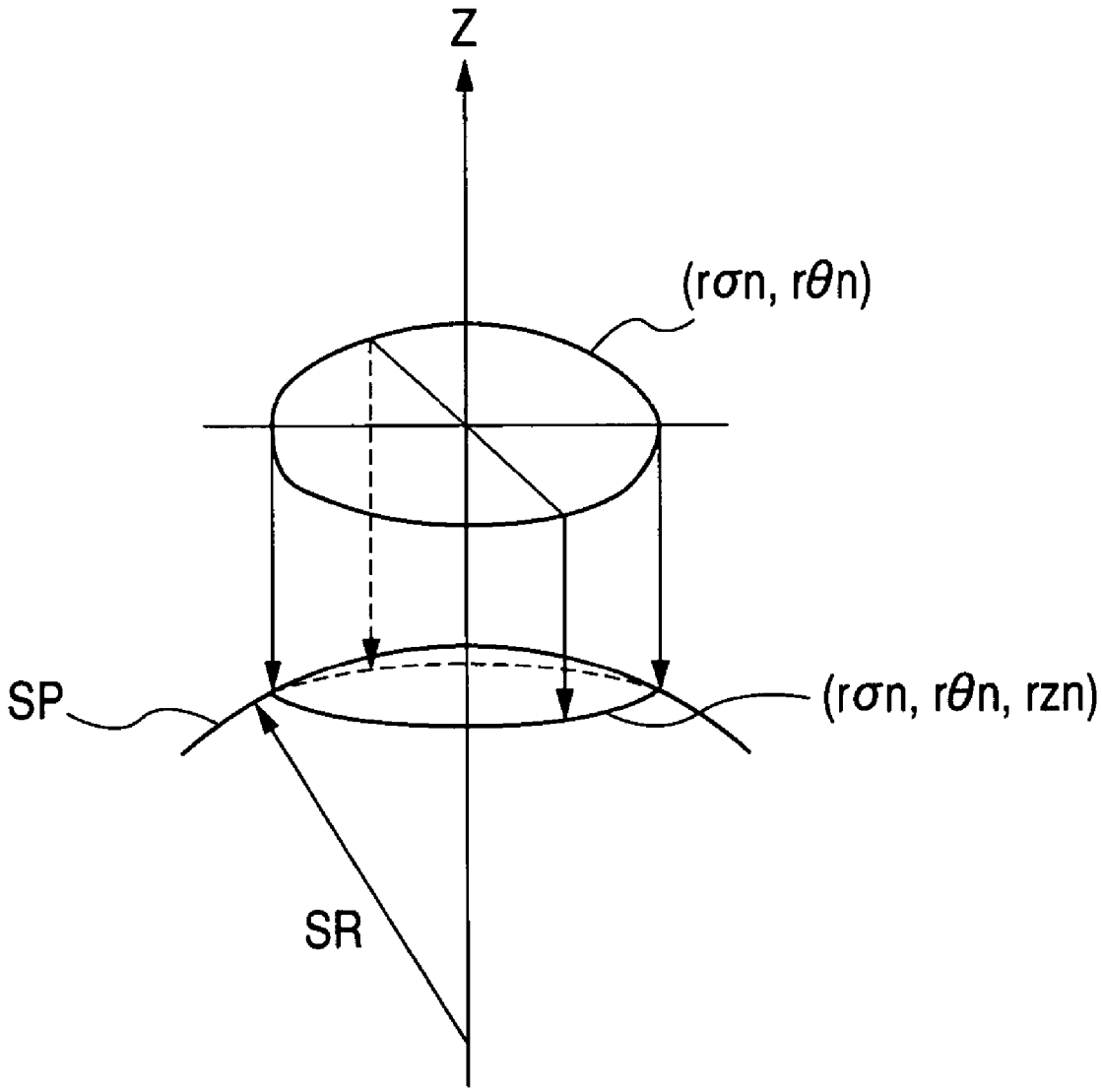
FIG. 8 is a graphic drawing for explaining an imaginary three-dimensional target lens shape created when the two-dimensional target lens shape is projected onto a sphere.

First, four points of the three-dimensional target lens shape data (Xn, Yn, Zn) are arbitrarily selected, and a radius SR of such a sphere SP that allows the four points to be distributed on its surface is calculated. Here, the calculation is made on the assumption that the center of the sphere SP is on the Z-axis. The two-dimensional target lens shape data (Xn, Yn) is again converted into polar coordinates data, to thereby obtain two-dimensional target lens shape data (rσn, rθn). The two-dimensional target lens shape data (rσn, rθn) is projected onto the sphere SP as shown in FIG. 8, and the Z-coordinate rzn on the surface of the sphere SP is calculated by the formula given below.

$$rzn=SR-(SR^2-r\sigma n^2)^{1/2}(n=1, 2, \ldots, N)$$

This gives the imaginary three-dimensional target lens shape data (rσn, rθn, rzn) (n=1, 2, . . . , N) on the sphere SP. Summing the distances between the respective data in the imaginary three-dimensional target lens shape data (rσn, rθn, rzn) (n=1, 2, . . . , N) gives a circumferential length FLSR of the imaginary three-dimensional target lens shape on the sphere SP which has the radius SR.

The circumferential length FLSR and the circumferential length FL are compared, thus to obtain a difference in circumferential length ΔFL (=FL−FLSR). If the circumferential length difference ΔFL is deviated from a predetermined permissible range, which is substantially 0, the imaginary three-dimensional target lens shape data (rσn, rθn, rzn) (n=1, 2, . . . , N) is recalculated based on a radius SR+α determined by appropriately increasing or decreasing the radius SR of the sphere SP, followed by recalculation of the circumferential length FLSR and thus obtaining the circumferential length difference ΔFL. Then, a radius SR of the sphere that satisfies the predetermined tolerance of the difference in circumferential length ΔFL is finally recalculated. In other words, the circumferential length FLSR calculated upon projecting the two-dimensional target lens shape onto the sphere SP having the finally obtained radius SR accurately accords with the circumferential length FL.

The two-dimensional target lens shape data (rσn, rθn) converted to the polar coordinates data, the finally obtained radius SR of the sphere SP by the circumferential length calculation, FPD and so on are transmitted from the measuring apparatus 100 to the order-issuing terminal 11. Here, the radius SR is customarily converted to a frame curvature Crv (523 divided by the radius SR in millimeter) for practical use. The radius SR, or the frame curvature Crv corresponds to the circumferential length-related data generated by associating the circumferential length FL with data of a different format. Data such as a pupil distance PD, material of the lens LE and the rim to be used for layout may be input to the measuring apparatus 100, so that such data can be simultaneously transmitted to the order-issuing terminal 11. The order issuing terminal 11 receives the input of data necessary for ordering the lens, such as degree prescription, in addition to the processing data transmitted by the measuring apparatus 100, and outputs all such data to the lens processing workshop 20.

The data that has been output is transmitted to the lens processing workshop 20 via the server 30 of the communications network NW, thus to be received by the order-receiving terminal 21. The processing data is sequentially output from the order-receiving terminal 21 to the processing apparatus 200.

A processing operation of the processing apparatus 200 will be described hereunder. After outputting the processing data received by the order-receiving terminal 21 to the processing apparatus 200, the lens LE is held by the lens rotating shafts 211L and 211R and the processing apparatus 200 is activated. The arithmetic control unit 350 first performs the measurement of the lens shape based on the two-dimensional target lens shape data (rσn, rθn) Once the front face shape and the rear face shape of the lens LE have been measured, calculation of the bevel path is performed based on the obtained edge position information, and the two-dimensional target lens shape data and the radius SR of the sphere SP transmitted from the eyeglass shop (if the frame curvature Crv has been transmitted, the radius SR is worked out from the frame curvature).

The calculation of the bevel path will be explained. First, the three-dimensional target lens circumferential length is restored, based on the two-dimensional target lens shape data (rσn, rθn) and the radius SR. The same concept as FIG. 8 referred to earlier is employed here, i.e. the two-dimensional target lens shape data (rσn, rθn) is again projected onto the sphere SP having the radius SR, so as to restore the three-dimensional target lens shape data. More specifically, the Z coordinate rzn on the sphere SP on which the two-dimensional target lens shape data (rσn, rθn) is projected is calculated by the formula of:

$$rzn=SR-(SR^2-r\sigma n^2)^{1/2}(n=1, 2, \ldots, N)$$

thus to restore the three-dimensional target lens shape data (rσn, rθn, rzn) (n=1, 2, . . . , N) on the sphere SP. Then, summing the distances between the respective data in the restored three-dimensional target lens shape data (rσn, rθn, rzn) restores the circumferential length FLSR. This value substantially accords with the circumferential length FL obtained by the measuring apparatus 100.

To calculate a peak point of the bevel path, a method of tracking the front face of the lens LE based on the edge position information, a method of dividing the edge thickness by a predetermined ratio (for example, 3:7), a method of matching with the curve of the rim, and so on are known. For example, in the case of dividing the edge thickness by a predetermined ratio, the positional data on the bevel peak point in a Z direction can be obtained as (rθn, yzn) (n=1, 2, . . . , N) by relating the bevel peak point to the radius vector angle rθn of the two-dimensional target lens shape data, and based on the front and rear face edge positions and the division ratio of the edge thickness. From the result, the bevel path data (rσn, rθn, yzn) (n=1, 2, . . . , N) can be obtained, therefore calculating and summing the distances between the respective data gives an approximate circumferential length YL of the bevel path. Then, the bevel path is calculated based on the corrected circumferential length YL, such that the circumferential length YL of the bevel path substantially accords with the restored circumferential length FLSR (i.e. satisfies a predetermined tolerance). In this apparatus, the correction of the bevel path for making the circumferential length YL of the bevel path substantially accord with the circumferential length FLSR is performed by converting into the processing data of the lens LE in the radius vector direction.

The processing data in the radius vector direction is handled as the data which varies the axis-to-axis distance L between the axial lines of the lens rotating shafts 211L and 211R and the grindstone rotating shaft 250 according to a movement of the carriage 210. The two-dimensional target lens shape data (rσn, rθn) is substituted in the following formula so as to obtain a maximum value of L. Here, R represents the radius of the grindstone 25.

$$L = r\delta n \cdot \cos r\theta n + \sqrt{R^2 - (r\delta n \cdot \sin r\theta n)^2} \quad (n = 1, 2, 3, \ldots, N) \qquad \text{Formula 1}$$

Then, (rσn, rθn) is rotated about the processing center by an arbitrary minute unit angle, and a maximum value of L in this state is calculated. Such a rotating angle is defined as ζi (i=1, 2, . . . , N) for executing the same calculation over an entire circumference, and maximum value of L at each ζi is defined as Li, and the corresponding rθn as Θi. The obtained (Li, ζi, Θi) (i=1, 2, . . . , N) is used as the processing data associated with the distance Then, a size correction amount Δ1 is obtained by:

$$\Delta 1 = (YL - FLSR)/2\pi$$

based on the circumferential length YL of the bevel path and the restored circumferential length FLSR. Then, a value Lai corrected from Li by Δ1 at every rotational angle ζi is obtained by:

$$Lai = Li - \Delta 1 (i = 1, 2, \ldots, N)$$

based on which the corrected beveling information (Lai, ζi, Zi) (i=1, 2, . . . , N) can be calculated. Here, Zi is obtained by converting the yzn of the bevel path data (rθn, yzn) to the relation with ζi.

Once the processing data has been calculated, the processing is executed by the grindstone 251. The arithmetic control unit 350 drives the motor 222 so as to move the carriage 210 such that the lens LE is located on the grindstone 251*a* or the grindstone 251*b*, and thus moves the carriage 210 up and down while driving the motor 215 to rotate the lens LE (changing the distance L between axial lines of the lens rotating shaft 211L and 211R and the grindstone rotating shaft 250) based on the processing data of the roughing (rough processing). By this process, the lens LE is shaped into the two-dimensional target lens shape.

Then, the lens LE is moved to the beveling groove of the grindstone 251*c*. In the beveling finish process, the position of the lens LE is controlled by the motor 215 based on the ζi of the beveling information (Lai, ζi, Zi) (i=1, 2, . . . , N); the motor 231 is controlled based on Lai; and the motor 222 is controlled based on Zi. As a result, the bevel path having the circumferential length that substantially accords with the actual circumferential length of the rim can be accurately formed around the periphery edge surface of the lens LE.

Although the present invention has been described based on the foregoing embodiment, the present invention is not limited to this embodiment. For example, the calculation of the restored circumferential length FLSR based on the two-dimensional target lens shape and the frame curvature (or the radius SR of the sphere) may be performed by another computer (such as the order-receiving terminal 21), instead of the arithmetic control unit 350 of the processing apparatus 200.

Further, the calculation of the bevel path having the circumferential length that substantially accords with the circumferential length FLSR, performed based the restored circumferential length FLSR, may be alternatively performed through calculating a ratio (FLSR/YL) between the restored circumferential length FLSR and the circumferential length YL of the bevel path obtained based on the edge position, and correcting the bevel path data (rσn, rθn, yzn) (n=1, 2, . . . , N) based on the obtained ratio.

Further, as a method of associating the circumferential length FL with data of a different format, the frame curvature or the sphere radius SR which is the base thereof is employed in the foregoing embodiment, however, the following method maybe adopted. For example, instead of correcting the radius SR, the two-dimensional target lens shape data is corrected. In other words, the radius SSR of a sphere in which arbitrary four points of the three-dimensional target lens shape data (XSn, Yn, Zn) of the rim are on the sphere is calculated. Then, a ratio ks between the circumferential length FLSSR and the circumferential length FL is obtained with respect to the three-dimensional target lens shape data corresponding to the state that the two-dimensional target lens shape data (rσn, rθn) (n=1, 2, . . . , N) is projected onto the sphere having the radius SSR, and the two-dimensional target lens shape data (rσn, rθn) is corrected based on the ratio ks. The corrected two-dimensional target lens shape data (ksrσn, rθn) (n=1, 2, . . . , N), and the radius SSR or the frame curvature Crvs to be obtained based thereon are employed as the output data (the frame curvature does not have to be strictly accurate, and, for example, radius data of a circle that passes through three points on an upper portion of the rim may simply be employed). On the side of the processing apparatus 200, the three-dimensional target lens shape data can be restored by projecting the corrected two-dimensional target lens shape data (ksrσn, rθn) (n=1, 2, . . . , N) onto the sphere having the radius SSR or a radius calculated from the frame curvature. The circumferential length calculated at this stage corresponds to the restored three-dimensional target lens circumferential length FLSR which substantially accords with the circumferential length FL. The subsequent steps are similar to the foregoing embodiment, i.e. the size correction amount Δ1 is calculated based on the circumferential length YL and the restored circumferential length FLSR, and the beveling information (Lai, ζi, Zi) (i=1, 2, . . . , N) corresponding to the corrected bevel path is calculated, and beveling processing is performed based on the result.

Alternatively, instead of associating the calculation of the restored circumferential length FLSR with the two-dimensional target lens shape data and the spherical radius SR or the frame curvature, the two-dimensional target lens shape data (ksrσn, rθn) (n=1, 2, . . . , N) may be corrected into the two-dimensional target lens shape data (Rσn, Rθn) such that the circumferential length of the two-dimensional target lens shape data (rσn, rθn) (n=1, 2, . . . , N) substantially accords with the circumferential length FL, and such corrected data may be output from the measuring apparatus 100. On the side of the processing apparatus 200, the circumferential length of the two-dimensional target lens shape data (Rσn, Rθn) (n=1, 2, . . . , N) is calculated, and the obtained value is converted to the restored circumferential length FLSR. The subsequent steps are similar to the foregoing embodiment, i.e. the size correction amount Δ1 is calculated based on the circumferential length YL and the restored circumferential length FLSR, and the beveling information (Lai, ζi, Zi) (i=1, 2, . . . , N) corresponding to the corrected bevel path is calculated, which allows performing accurate processing. The processing apparatus 200 may calculate the two-dimensional circumferential length along with the two-dimensional target lens shape data (Rσn, Rθn) (n=1, 2, . . . , N), and output such data.

Still further, the circumferential length F2L of the two-dimensional target lens shape data (rσn, rθn) (n=1, 2, . . . , N) may be calculated, and a circumferential length correction coefficient K1 of the ratio of the circumferential length FL with respect to such circumferential length F2L may be calculated, to thereby output the two-dimensional target lens shape data (rσn, rθn) and the circumferential length correction coefficient K1 on the side of the processing apparatus 200, the circumferential length FLSR can be restored based on the circumferential length F2L of the received two-dimensional target lens shape data (rσn, rθn) and the circumferential length correction coefficient K1.

What is claimed is:

1. A method of processing an eyeglass lens comprising:

a first step of obtaining an actual three-dimensional target lens shape from a rim of an eyeglass frame;

a second step of obtaining a circumferential length of the actual three-dimensional target lens shape and a two-dimensional target lens shape based on the actual three-dimensional target lens shape;

a third step of transmitting at least the two-dimensional target lens shape without transmitting the circumferential length of the actual three-dimensional target lens shape;

a fourth step of obtaining a circumferential length of a three-dimensional target lens shape restored based on the transmitted two-dimensional target lens shape;

a fifth step of obtaining a bevel path having a circumferential length that substantially accords with the circumferential length of the restored three-dimensional target lens shape; and a sixth step of forming a bevel on a peripheral edge surface of the lens based on the obtained bevel path.

2. The method according to claim 1 further comprising a step of obtaining a radius of a sphere in which a circumferential length of an imaginary three-dimensional target lens shape obtained by projecting the two-dimensional target lens shape onto the sphere substantially accords with the circumferential length of the actual three-dimensional target lens shape, wherein in the third step, the two-dimensional target lens shape and the sphere radius are transmitted, and wherein in the fourth step, the circumferential length of the restored three-dimensional target lens shape is obtained based on the transmitted two-dimensional target lens shape and the transmitted sphere radius.

3. The method according to claim 1 further comprising:

a step of obtaining a radius of a sphere on which the actual three-dimensional target lens shape is; and a step of obtaining a corrected two-dimensional target lens shape in which a circumferential length of an imaginary three-dimensional target lens shape obtained by projecting the corrected two-dimensional target lens shape onto the sphere substantially accords with the circumferential length of the actual three-dimensional target lens shape, wherein in the third step, the corrected two-dimensional target lens shape and the sphere radius are transmitted, and wherein in the fourth step, the circumferential length of the restored three-dimensional target lens shape is obtained based on the transmitted corrected two-dimensional target lens shape and the transmitted sphere radius.

4. The method according to claim 1 further comprising a step of obtaining a corrected two-dimensional target lens shape in which a circumferential length of the corrected two-dimensional target lens shape substantially accords with the circumferential length of the actual three-dimensional target lens shape, wherein in the third step, the corrected two-dimensional target lens shape is transmitted, and wherein in the fourth step, the circumferential length of the restored three-dimensional target lens shape is obtained based on the circumferential length of the transmitted corrected two-dimensional target lens shape.

5. The method according to claim 1 further comprising a step of obtaining a correction coefficient for correcting the two-dimensional target lens shape so that a circumferential length of the corrected two-dimensional target lens shape substantially accords with the circumferential length of the actual three-dimensional target lens shape, wherein in the third step, the two-dimensional target lens shape and the correction coefficient are transmitted, and wherein in the fourth step, the circumferential length of the restored three-dimensional target lens shape is obtained based on the circumferential length of the transmitted two-dimensional target lens shape and the transmitted correction coefficient.

6. An eyeglass lens processing system comprising:

a target lens shape measuring apparatus that obtains an actual three-dimensional target lens shape from a rim of an eyeglass frame;

an eyeglass lens processing apparatus that forms a bevel on a peripheral edge surface of an eyeglass lens; and a transmitting portion that connects the measuring apparatus to the processing apparatus, wherein the measuring apparatus includes a first arithmetic portion for obtaining a circumferential length of the actual three-dimensional target lens shape and a two-dimensional target lens shape based on the actual three-dimensional target lens shape, wherein the transmitting portion transmits at least the two-dimensional target lens shape without transmitting the circumferential length of the actual three-dimensional target lens shape, wherein the processing apparatus includes a second arithmetic portion for obtaining a circumferential length of a three-dimensional target lens shape restored based on the transmitted two-dimensional target lens shape, and obtaining a bevel path having a circumferential length that substantially accords with the circumferential length of the restored three-dimensional target lens shape.

7. The eyeglass lens processing system according to claim 6, wherein the first arithmetic portion obtains a radius of a sphere in which a circumferential length of an imaginary three-dimensional target lens shape obtained by projecting the two-dimensional target lens shape onto the sphere substantially accords with the circumferential length of the actual three-dimensional target lens shape, wherein the transmitting portion transmits the two-dimensional target lens shape and the sphere radius, and wherein the second arithmetic portion obtains the circumferential length of the restored three-dimensional target lens shape based on the transmitted two-dimensional target lens shape and the transmitted sphere radius.

8. The eyeglass lens processing system according to claim 6, wherein the first arithmetic portion obtains a radius of a sphere on which the actual three-dimensional target lens shape is, and obtains a corrected two-dimensional target lens shape in which a circumferential length of an imaginary three-dimensional target lens shape obtained by projecting the corrected two-dimensional target lens shape onto the sphere substantially accords with the circumferential length of the actual three-dimensional target lens shape, wherein the transmitting portion transmits the corrected two-dimensional target lens shape and the sphere radius, and wherein the second arithmetic portion obtains the circumferential length of the restored three-dimensional target lens shape based on the transmitted corrected two-dimensional target lens shape and the transmitted sphere radius.

9. The eyeglass lens processing system according to claim 6, wherein the first arithmetic portion obtains a corrected two-dimensional target lens shape in which a circumferential length of the corrected two-dimensional target lens shape substantially accords with the circumferential length of the actual three-dimensional target lens shape, wherein the transmitting portion transmits the corrected two-dimensional target lens shape, and wherein the second arithmetic portion obtains the circumferential length of the restored three-dimensional target lens shape based on the circumferential length of the transmitted corrected two-dimensional target lens shape.

10. The eyeglass lens processing system according to claim 6, wherein the first arithmetic portion obtains a correction coefficient for correcting the two-dimensional target lens shape so that a circumferential length of the corrected two-dimensional target lens shape substantially accords with the circumferential length of the actual three-dimensional target lens shape, wherein the transmitting portion transmits the two-dimensional target lens shape and the correction coefficient, and wherein the second arithmetic portion obtains the circumferential length of the restored three-dimensional target lens shape based on the circumferential length of the transmitted two-dimensional target lens shape and the transmitted correction coefficient.

11. A target lens shape measuring apparatus comprising:

a measuring portion that obtains an actual three-dimensional target lens shape from a rim of an eyeglass frame;

an arithmetic portion that obtains a circumferential length of the actual three-dimensional target lens shape and a two-dimensional target lens shape based on the actual three-dimensional target lens shape; and an outputting portion that outputs at least the two-dimensional target lens shape without outputting the circumferential length of the actual three-dimensional target lens shape; and wherein the arithmetic portion obtains a radius of a sphere in which a circumferential length of an imaginary three-dimensional target lens shape obtained by projecting the two-dimensional target lens shape onto the sphere substantially accords with the circumferential length of the actual three-dimensional target lens shape, and the outputting portion transmits the two-dimensional target lens shape and the sphere radius.

12. A target lens shape measuring apparatus comprising:

a measuring portion that obtains an actual three-dimensional target lens shape from a rim of an eyeglass frame;

an arithmetic portion that obtains a circumferential length of the actual three-dimensional target lens shape and a two-dimensional target lens shape based on the actual three-dimensional target lens shape; and an outputting portion that outputs at least the two-dimensional target lens shape without outputting the circumferential length of the actual three-dimensional target lens shape; and wherein the arithmetic portion obtains a radius of a sphere on which the actual three-dimensional target lens shape is, and obtains a corrected two-dimensional target lens shape in which a circumferential length of an imaginary three-dimensional target lens shape obtained by projecting the corrected two-dimensional target lens shape onto the sphere substantially accords with the circumferential length of the actual three-dimensional target lens shape, and wherein the transmitting portion transmits the corrected two-dimensional target lens shape and the sphere radius.

13. A target lens shape measuring apparatus comprising:

a measuring portion that obtains an actual three-dimensional target lens shape from a rim of an eyeglass frame;

an arithmetic portion that obtains a circumferential length of the actual three-dimensional target lens shape and a two-dimensional target lens shape based on the actual three-dimensional target lens shape; and an outputting portion that outputs at least the two-dimensional target lens shape without outputting the circumferential length of the actual thee-dimensional target lens shape; and wherein the arithmetic portion obtains a corrected two-dimensional target lens shape in which a circumferential length of the corrected two-dimensional target lens shape substantially accords with the circumferential length of the actual three-dimensional target lens shape, and wherein the outputting portion transmits the corrected two-dimensional target lens shape.

14. A target lens shape measuring apparatus comprising:

a measuring portion that obtains an actual three-dimensional target lens shape from a rim of an eyeglass frame;

an arithmetic portion that obtains a circumferential length of the actual three-dimensional target lens shape and a two-dimensional target lens shape based on the actual three-dimensional target lens shape; and an outputting portion that outputs at least the two-dimensional target lens shape without outputting the circumferential length of the actual three-dimensional target lens shape; and wherein the arithmetic portion obtains a correction coefficient for correcting the two-dimensional target lens shape so that a circumferential length of the corrected two-dimensional target lens shape substantially accords with the circumferential length of the actual three-dimensional target lens shape, and wherein the outputting portion transmits the two-dimensional target lens shape and the correction coefficient.

* * * * *